US005735395A

United States Patent [19]

Lo

[11] Patent Number: 5,735,395

[45] Date of Patent: Apr. 7, 1998

[54] AIRTIGHT GARMENT HANGING BAG

[76] Inventor: Luke Lo, No. 9, Lane 34 Chin Men St., Taipei, Taiwan

[21] Appl. No.: 671,645

[22] Filed: Jun. 28, 1996

[51] Int. Cl.[6] ..... B65D 33/14; B65D 33/24; B65D 85/18; B65D 81/20

[52] U.S. Cl. ..... 206/278; 206/278.1; 206/524.8; 383/23; 383/68

[58] Field of Search ..... 206/278, 524.8, 206/278.1; 383/15, 23, 68, 3

[56] References Cited

U.S. PATENT DOCUMENTS

| | | | |
|---|---|---|---|
| 3,462,068 | 8/1969 | Suominen | 383/23 |
| 3,486,683 | 12/1969 | Kamins et al. | 383/23 |
| 3,811,543 | 5/1974 | Parrochia | 383/41 X |
| 5,240,112 | 8/1993 | Newburger | 206/524.8 |
| 5,332,095 | 7/1994 | Wu | 206/524.8 |
| 5,542,766 | 8/1996 | Cadwallader | 383/68 X |
| 5,622,431 | 4/1997 | Simonsen | 383/68 X |

FOREIGN PATENT DOCUMENTS

| | | | |
|---|---|---|---|
| 543766 | 5/1993 | European Pat. Off. | 383/68 |

*Primary Examiner*—Sue A. Weaver
*Attorney, Agent, or Firm*—Bacon & Thomas

[57] ABSTRACT

An airtight garment hanging bag has an entrance on lower side for receiving a garment and a clip strip disposed at the entrance, which has a length slightly longer than the width of the entrance. The clip strip is formed with a lengthwise central bending section which divides the clip strip into upper and lower clip plates. The edges of the upper and lower clip plates are respectively formed with a hook section and a latch section, whereby after the garment is placed into the garment bag through the entrance, the bottom edge of the entrance is reversely folded and the clip strip is bent about the bending section so as to engage the upper and lower clip plates with each other by means of the hook section and latch section for airtightly sealing the entrance. A sucking nozzle is disposed on the upper side of the garment bag. After the air in the garment bag is sucked out from the, sucking nozzle, a clip member having a clip seat and clip base is used to clip and seal the sucking nozzle to keep the garment bag in a completely airtight state, by reversely folding and placing the sucking nozzle between the clip board and the clip seat and then engaging them to seal the sucking nozzle. A hanging support is disposed on the top edge of the clip seat for hanging the garment bag.

8 Claims, 8 Drawing Sheets

AIRTIGHT GARMENT HANGING BAG

BACKGROUND OF THE INVENTION

The present invention relates to a garment hanging bag which is able to conveniently airtightly enclose and store a garment without infiltration of humidity and bacteria.

FIGS. 6, 7 and 8 show a conventional garment bag, wherein a thermoplastic adhesive 6 is painted on an inner edge of an entrance 51 of the garment bag 5 and a sucking member 7 is disposed on the garment bag 5. The sucking member 7 includes a seat body 71 formed with a central sucking hole 72 and attached under a small opening of the garment bag 5. In order to prevent the garment from blocking the sucking hole 72 during sucking procedure, a convex vented disk 73 is disposed under the seat body 71. A clamping disk 74 is disposed above the sucking hole 72 of the seat body 71 and a rotary sucking member 75 is passed from upper side to lower side through a central hole of the clamping disk 74 to be screwed with a central thread hole of the seat body 71. Therefore, the clamping disk 74 is forced to tightly clamp the peripheral portion around the small opening of the garment bag 5. A silicone plug 76 is disposed at bottom end of the rotary sucking member 75, whereby after the garment is placed into the garment bag 5, an iron can be used to iron and fuse the thermoplastic adhesive 6 so as to seal the entrance 51. Then the rotary sucking member 75 is gradually rotated to suck the air out of the garment bag 5 until the silicone plug 76 corks the sucking hole 72. Such arrangement serves to suck out the air in the garment bag. However, the thermoplastic adhesive is subject to deterioration after a period of use and the user may iron the thermoplastic adhesive unevenly. These will lead to poor sealing effect. Moreover, the peripheral portion around the small opening of the garment bag 5 is only clamped by the seat body 71 and the clamping disk 74 so that no matter how tightly the rotary sucking disk 75 is tightened, it is still difficult to achieve an optimal airtight sealing effect. In addition, it is quite troublesome to iron the thermoplastic adhesive for sealing the entrance and once the entrance is opened, the entrance cannot be re-sealed for further use. This causes waste of resource. Furthermore, the sucking member is composed of many complicated components. This increases the manufacturing cost and assembling time. Also, such garment bag is not equipped with hanging support so that the garment cannot be stored in a hanging state.

SUMMARY OF THE INVENTION

It is a primary object of the present invention to provide an improved airtight garment hanging bag to eliminate the above problems. The garment hanging bag has an entrance on lower side for a garment to be placed therein. A clip strip is disposed at the entrance and formed with a lengthwise central bending section which divides the clip strip into an upper and a lower clip plates. After the garment is placed into the garment bag through the entrance, the bottom edge of the entrance is reversely folded and the clip strip is bent about the bending section so as to engage the upper and lower clip plates with each other to airtightly seal the entrance. A sucking nozzle is disposed on the upper side of the garment bag. After the air in the garment bag is sucked out from the sucking nozzle, a clip member is used to clip and seal the sucking nozzle to keep the garment bag in a completely airtight state without infiltrantion of humidity and bacteria. A hanging support is disposed on the top edge of the clip seat for hanging the garment bag.

The present invention can be best understood through the following description and accompanying drawings, wherein:

BRIEF DESCRIPTION OF THE DRAWINGS

FIG. 2-1 is a sectional view according to FIG. 2, showing that the entrance is sealed by the clip strip;

FIG. 4-1 is a cross-sectional view according to FIG. 4, showing that the sucking nozzle is sealed by the clip member;

FIG. 5-1 is a longitudinal sectional view according to FIG. 5, showing that the clip board is unlatched from the clip seat;

DETAILED DESCRIPTION OF THE PREFERRED EMBODIMENTS

Figure 1:
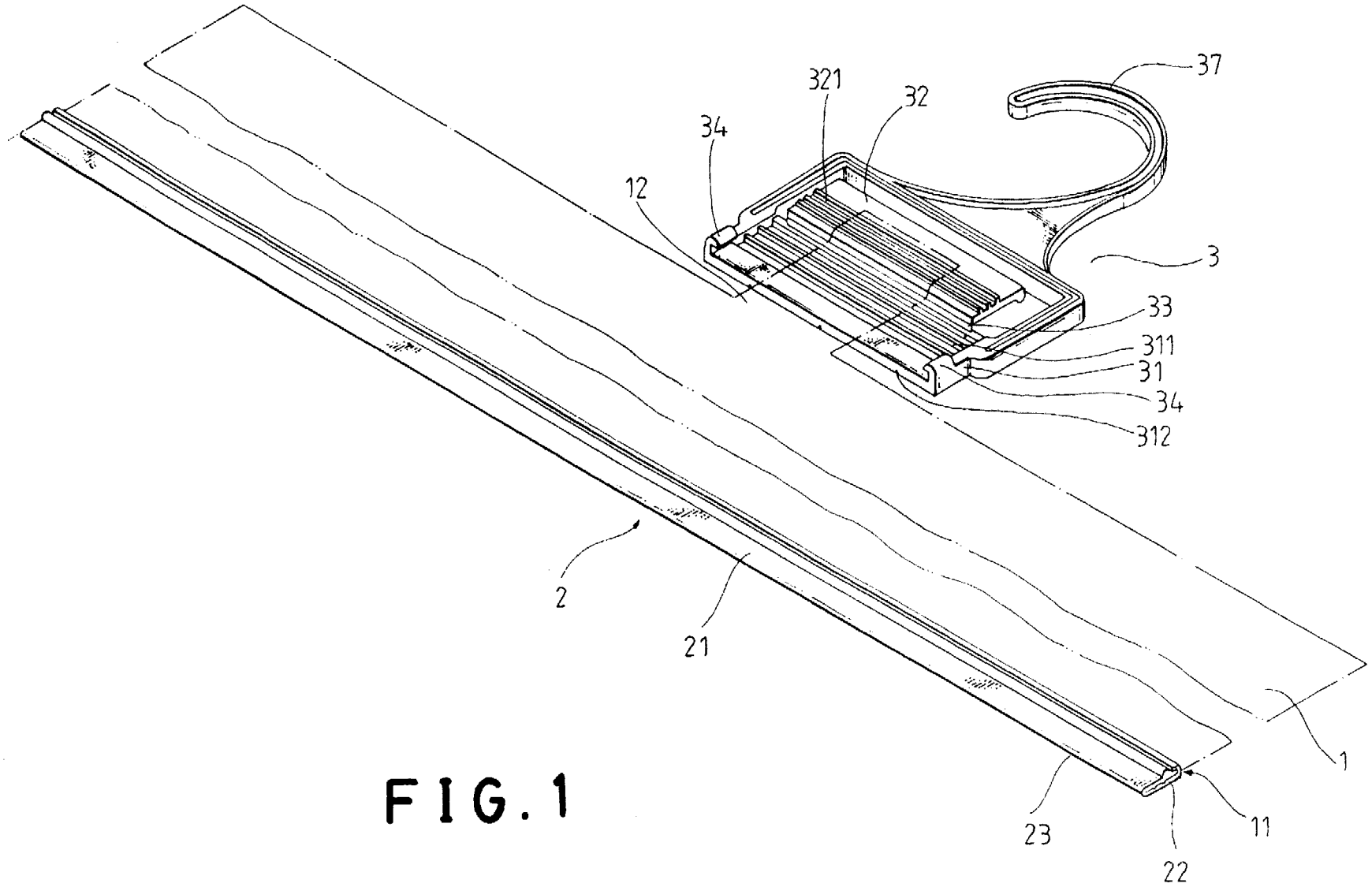
FIG. 1 is a perspective view of the present invention.
Figure 2:
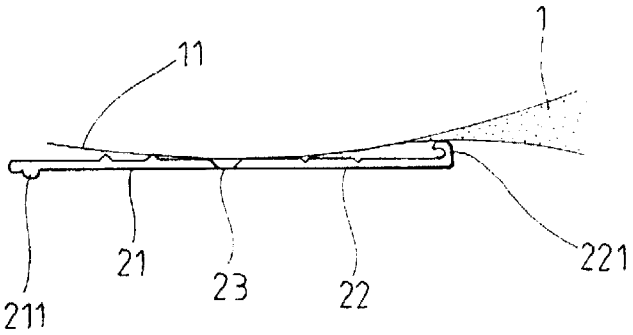
FIG. 2 is a sectional view showing the entrance of the garment bag and the clip strip of the present invention before sealing.
Figures 1, 2:
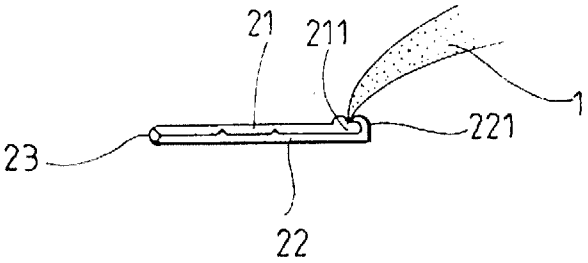

Please refer to FIG. 1. The present invention includes a garment bag 1 having an entrance 11 on lower side for a garment to be placed therein and a clip strip 2 disposed at the entrance 11, which has a length slightly longer than the width of the entrance 11. The clip strip 2 is made by integral injection molding and formed with a lengthwise central bending section 23 which divides the clip strip 2 into upper and lower clip plates 21, 22. The edges of the upper and lower clip plates 21, 22 are respectively formed with a hook section 211 and a latch section 221, whereby after the garment is placed into the garment bag 1 through the entrance 11, the clip strip 2 is bent about the bending section 23 so as to engage the upper and lower clip plates 21, 22 with each other by means of the hook section 221 and latch section 211. Accordingly, the bottom edge of the entrance 11 is first reversely folded and then clamped between the upper and lower clip plates 21, 22 so as to seal the garment bag 1 as shown in FIGS. 1 and 2-1.

Figure 3:
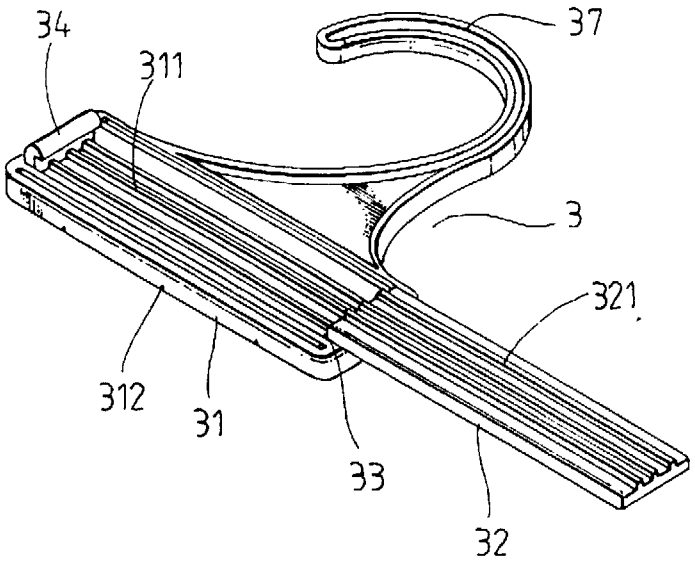
FIG. 3 is a perspective view of another embodiment of the clip member of the present invention.
Figure 4:
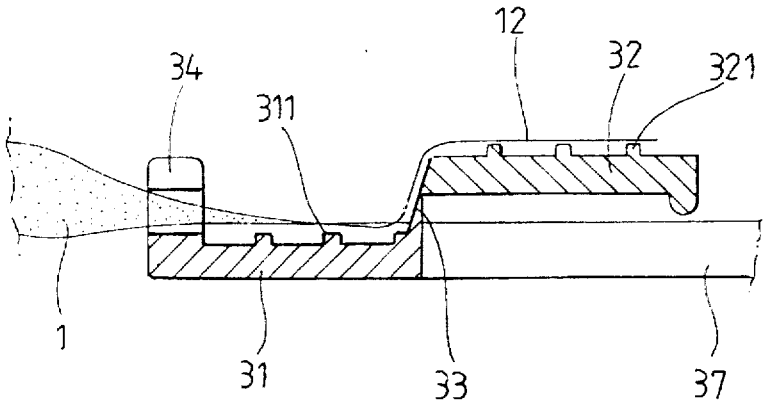
FIG. 4 is a cross-sectional view showing the sucking nozzle and clip member of the present invention before sealing.
Figures 1, 4:
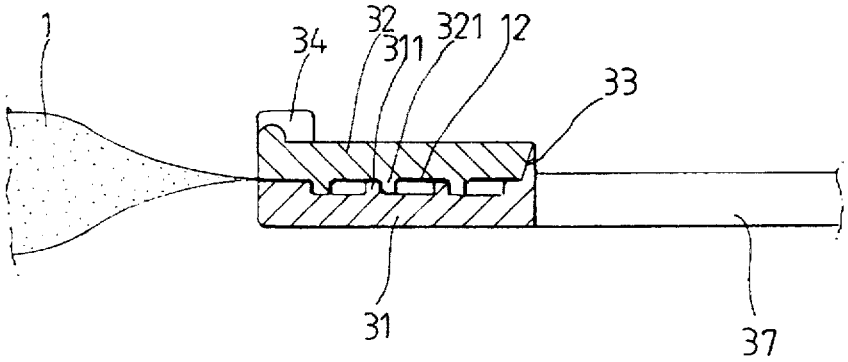
Figure 5:
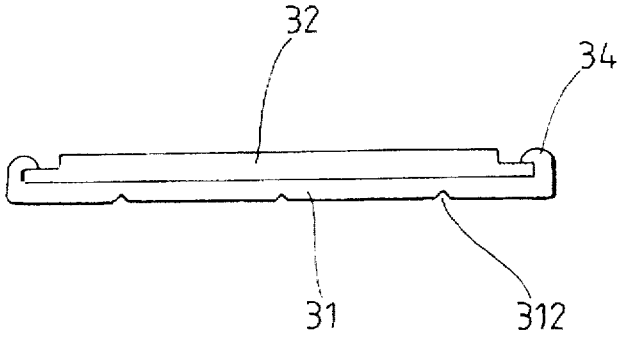
FIG. 5 is a longitudinal sectional view showing that the clip board is latched by the clip seat of the clip member of the present invention.
Figures 1, 5:
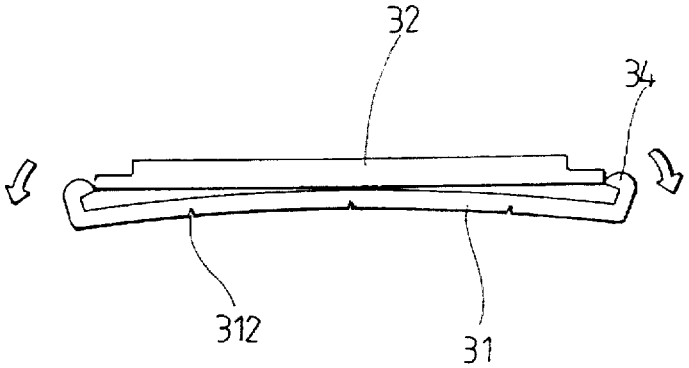
Figure 6:
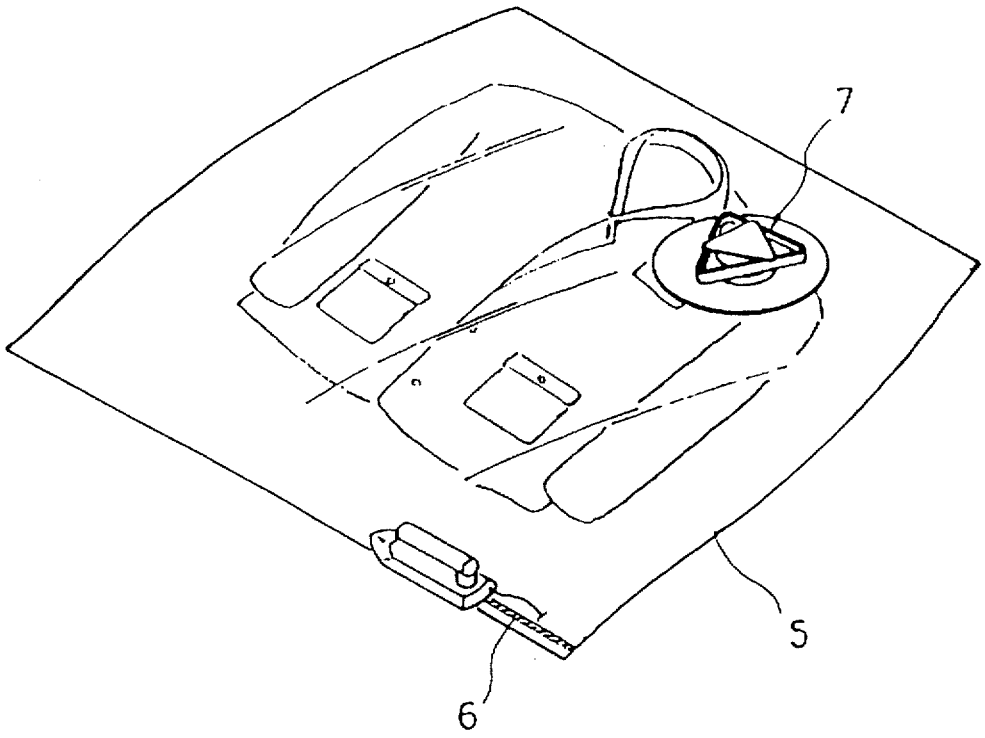
FIG. 6 is a perspective view of a conventional garment bag in which a garment is enclosed.
Figure 7:
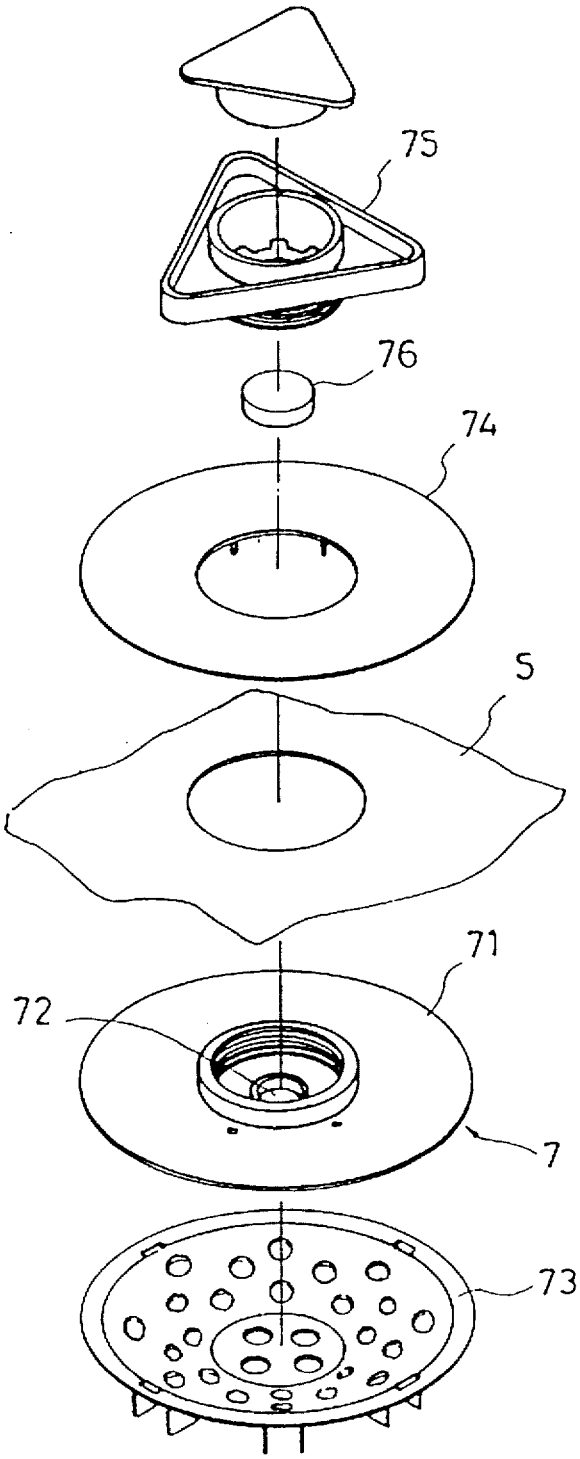
FIG. 7 is a perspective exploded view of the sucking member of the conventional garment bag.
Figure 8:
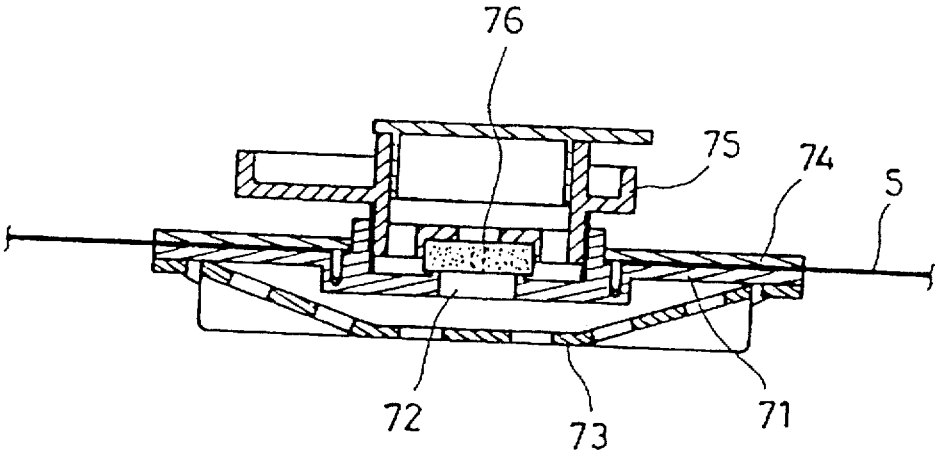
FIG. 8 is a sectional assembled view of the sucking member of the conventional garment bag.

Please further refer to FIGS. 1, 3 and 4. A sucking nozzle 12 is disposed at a central section of the upper side of the garment bag 1. After the entrance 11 is sealed, the air in the garment bag 1 is sucked out from the sucking nozzle 12. Thereafter, a clip member 3 is used to clip and seal the sucking nozzle 12 to keep the garment bag 1 in a completely airtight state. The clip member 3 includes a clip seat 31 and a clip board 32 interconnected by a folding section 33. A set of latch edges 34 are formed on two lateral sides of upper edge of the clip seat 31 and the clip board 32 and multiple interlaced projecting clipping teeth 311, 321 are disposed on the clipping faces of the clip seat 31 and the clip board 32. In addition, multiple tension channels 312 are formed on the bottom face of the clip seat 31, whereby the latch edges 34 of the clip seat 31 are provided with a tensility for facilitating the disengagement of the clip board 32 from the clip seat 31 as shown in FIGS. 5 and 5-1. When clipped, the sucking nozzle 12 is first reversely folded and placed between the clip board 32 and the clip seat 31. Then the clip board 32 is engaged with the clip seat 31 to seal the sucking nozzle. At this time, the clipping teeth 311, 321 are interlacedly engaged with each other to enhance the clipping and sealing effect for the sucking nozzle 12. In addition, a hanging support 37 is disposed on the top edge of the clip seat 31 for hanging the garment bag. By means of the above arrangement, the garment can be more quickly and conveniently airtightly enclosed and stored without infiltration of humidity and bacteria.

Referring to FIGS. 1 and 3, the position of the folding section 33 can be modified to create two different patterns of clip members 3. However, the basic technical concept is identical and should be included in the spirit of the present invention.

It should be noted that the above description and accompanying drawings are only used to illustrate some embodiments of the present invention, not intended to limit the scope thereof. Any modification of the embodiments should fall within the scope of the present invention.

What is claimed is:

1. A garment hanging bag comprising a garment bag, a clip strip and a clip member, the garment bag having an entrance on an edge for a garment to be placed therein, the clip strip having a length slightly longer than a width of the entrance, the clip strip including an upper and a lower clip plates which are engageable with each other to clip and seal the entrance, a sucking nozzle being disposed on another edge of the garment bag, the clip member being used to clip and seal the sucking nozzle, and wherein a hanging support is disposed on a top edge of the clip member for hanging the garment bag.

2. A garment hanging bag as claimed in claim 1, wherein the clip strip is directly attached to the entrance.

3. A garment hanging bag as claimed in claim 1, wherein the clip strip is formed with a lengthwise central bending section dividing the clip strip into the upper and lower clip plates.

4. A garment hanging bag as claimed in claim 1, wherein the upper and lower clip plates are respectively formed with corresponding hook section and latch section on the edges for tightly engaging the upper and lower clip plates with each other.

5. A garment hanging bag as claimed in claim 1, wherein the clip member includes a clip seat and a clip board interconnected by a folding section.

6. A garment hanging bag as claimed in claim 5, wherein at least one lateral side of the clip seat and clip board is formed with a set of latch edges for engaging the clip board with the clip seat.

7. A garment hanging bag as claimed in claim 5, wherein multiple interlaced projecting clipping teeth are formed on clipping faces of the clip seat and the clip board.

8. A garment hanging bag as claimed in claim 5, wherein at least one outer lateral side of the clip seat and clip board is formed with multiple tension channels.

* * * * *